US005642648A

United States Patent [19]

Wendt et al.

[11] Patent Number: 5,642,648

[45] Date of Patent: Jul. 1, 1997

[54] CAR DOOR LATCH RELEASE TOOL

[75] Inventors: Adulbert Wendt, Bergheim, Germany; Alan Goeke, Hinsdale; Giles Kalvelage, II, Hanover Park, both of Ill.

[73] Assignee: HPC, Inc., Schiller Park, Ill.

[21] Appl. No.: 681,881

[22] Filed: Jul. 29, 1996

Related U.S. Application Data

[63] Continuation of Ser. No. 529,088, Sep. 15, 1995, abandoned.

[51] Int. Cl.[6] ..... B25B 33/00

[52] U.S. Cl. ..... 81/15.9; 81/488

[58] Field of Search ..... 81/15.9, 488, 18, 81/19.1; 294/26; 70/465, 394

[56] References Cited

U.S. PATENT DOCUMENTS

| | | | |
|---|---|---|---|
| 2,344,696 | 3/1944 | Graham | 81/15.9 |
| 3,195,380 | 7/1965 | Bicks | 294/19.1 |
| 3,840,969 | 10/1974 | Landis | 294/19.1 |
| 4,144,778 | 3/1979 | Waring . | |
| 4,608,886 | 9/1986 | Bolton . | |
| 4,683,783 | 8/1987 | Fanberg | 81/15.9 |
| 4,836,961 | 6/1989 | Weinraub . | |
| 4,882,954 | 11/1989 | Selby . | |
| 4,950,015 | 8/1990 | Nejib et al. | 294/19.1 |

*Primary Examiner*—D. S. Meislin
*Assistant Examiner*—Joni B. Danganan
*Attorney, Agent, or Firm*—David D. Kaufman

[57] ABSTRACT

A tool for non-destructively unlatching the door handle of a vehicle which has been locked with the window upraised. The tool comprises a relatively rigid elongate tube which is insertable into the door cavity, and the tube has a relatively rigid gripping rod slidably positioned therein. At its front end, the gripping rod has an eyelet which is adapted to hook onto a latching linkage rod located within the vehicle door. An operating handle is secured to the rear end of the gripping rod and, by pulling and withdrawing the gripping rod, a positive gripping force is exerted on the latching link rod so that the same may be moved to unlatch the door handle. Two embodiments are disclosed whereby the tool is effective for use with vertically or horizontally oriented linkage rods.

12 Claims, 2 Drawing Sheets

CAR DOOR LATCH RELEASE TOOL

This is a continuation of application Ser. No. 08/529,088, filed Sep. 15, 1995 now abandoned.

BACKGROUND OF THE INVENTION

This invention relates to devices for non-destructive and keyless entry to locked automobiles and, more particularly, to a tool for unlatching the door lock to permit handle opening of the door.

Incidents of inadvertent locking of car doors with the keys still inside and of losing the car keys after locking the doors are common and all too well known. Non-destructive opening of the car door in such cases frequently requires the services of a trained locksmith. The need for gaining access to abandoned or illegally parked cars by police or other authorities is likewise a common occurrence.

Many tools have heretofore been provided for coping with this problem. In general, tools of the type under consideration comprise thin or slender devices designed to pass between the upraised door window and the outer door sill and into the door or cab interior whereupon the locksmith or officer is required to manipulate the tool end until it catches or hooks a desired link or handle in or on the car door. The prior tools ranged from long and thin blades commonly known as "slim jims" to a variety of hooked wires. Instruments of the latter type may be seen in U.S. Pat. Nos. 4,144,778, 4,608,886, 4,836,061, and 4,882,954. In some cases, implements were designed to function only with a particular make of automobile.

Different car manufacturers employ different locking and latching arrangements and devices. A common and widespread latching device comprises a vertical link terminating in a short post or push button which projects above the inner sill of the door. The latch is actuated by pressing the post to a downward position which engages and prevents operation of the door handle. The reverse motion, or lifting up, of the post unlatches the door handle and frees the same for opening the door. U.S. Pat. No. 4,144,778 cited above sought to operate on the latching post, but that device was relatively complex and difficult to manipulate, including the use of a tether string.

Another latching arrangement comprises horizontal linkage and a horizontally slidable switch on the inside of the door. U.S. Pat. No. 4,608,886 shows a device designed to operate on such horizontal linkage, but that device was also complex and difficult to manipulate.

There thus exists a need for a tool which is capable of operation on the car door latching post or on the horizontally slidable linkage and which is simple to use and effective in operation.

BRIEF SUMMARY OF THE INVENTION

The present invention provides a tool adapted to act upon the generally vertical link of a latching post or the horizontally slidable linkage found in many makes of automobiles. The tool has means for positively gripping the links so that unlatching upward movement of the post or horizontal sliding of the switch can be achieved even where rust or aging tends to resist such movement. The tool is simple to operate and is relatively rigid and durable to resist deflection or bending and thereby render more efficient its operation.

Briefly, the invention comprises an elongate tube which is arcuately bent so that its distal end is conveniently positioned for locating the vertical or horizontal latching link when the tool is inserted into the door. A first handle is fixedly mounted on the tube near its proximal or operator end. A fine rod is slidably mounted in the tube and extends outwardly beyond the tube at both ends of the latter. At its distal end, the rod is provided with an eyelet form or hook adapted to catch onto the linkage rod. At its proximal, or operator, end the rod has fixedly mounted thereon a second handle for sliding the rod within the tube. With simple manipulation of the second handle, the forwardly projecting rod may be hooked onto the latch post link or horizontal link and then pulled rearwardly to obtain a positive grip on the particular link for achieving movement thereof. Withdrawal of the tool after opening of the latch is equally simple.

Numerous other advantages and features of the present invention will become apparent from the following detailed description of the invention, from the claims and from the accompanying drawings.

BRIEF DESCRIPTION OF THE DRAWINGS

In the accompanying drawings forming a part of the specification, and in which like numerals are employed to designate like parts throughout.

DETAILED DESCRIPTION OF THE INVENTION

Figure 4:
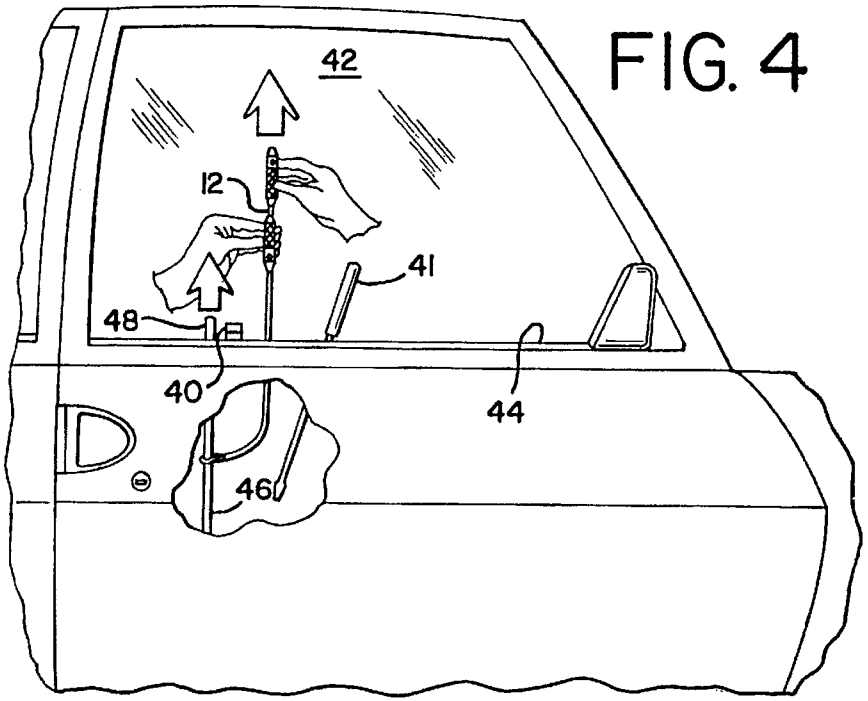
FIG. 4 is a fragmentary view showing the tool in operation inserted into a vehicle door and in operational position with a positive grip on the vertical latch post link.
Figure 5:
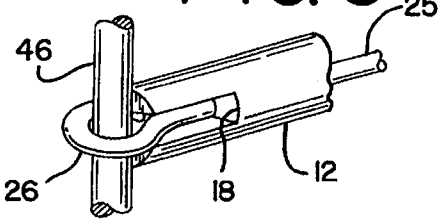
FIG. 5 is an enlarged fragmentary perspective view showing the latch post link in positively gripped relationship.

Referring in greater detail to the drawings, the reference numeral 10 indicates generally a tool embodying the principles of the invention. Tool 10 comprises an elongate tube 12 having a distal end 14 and being formed with a gradual, arcuate bend 16 adjacent said distal end. Distal end 14 is provided with a horizontal slot 18 for reasons which will become apparent as the description proceeds. At the operator, or proximal, end 20 of the tube 12, a first handle 22 is rigidly mounted thereon forwardly of said proximal end 20.

Figure 2:
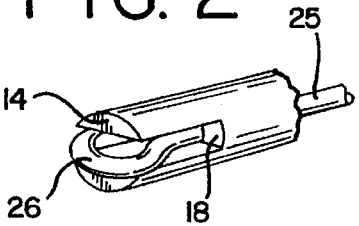
FIG. 2 is an enlarged fragmentary perspective view showing the gripping rod fully retracted.
Figure 3:
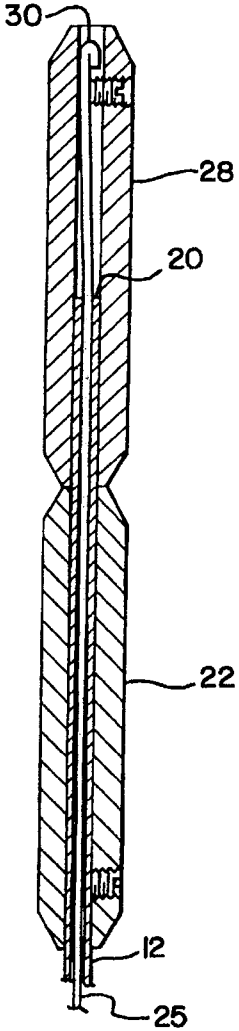
FIG. 3 is an enlarged sectional view on the plane of line 3—3 in FIG. 1.
Figure 1:
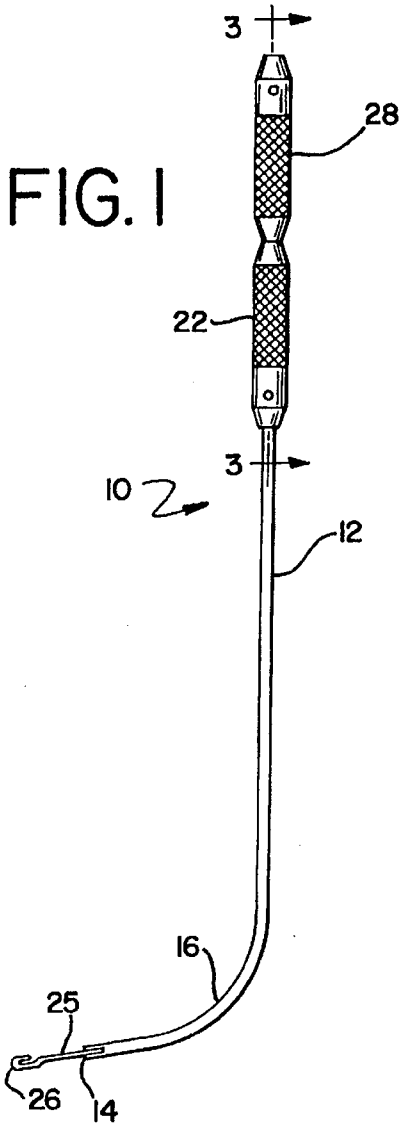
FIG. 1 is an elevational view of a latch release tool embodying the principles of the invention showing the same with the gripping rod fully extended.

A thin gripping rod 25 is slidably and reciprocably mounted in the tube 12, said rod being of greater length than the tube and extending outwardly from both ends of the tube. The distal end of the rod 25 comprises an eyelet or hook 26. As indicated in FIG. 2, the slot 18 of the tube 12 is adapted to accommodate and sheathe portions of the hook 26 therein. A second or operating handle 28 is secured to the proximal end 30 of the rod 25. The second handle 28 is tubular in form and slidably carried on the tube 12. It will thus be appreciated that the rod 25 may be extended from or retracted into the tube 12 by pushing and pulling on the second handle 28.

Referring now to FIG. 4 of the drawings, operation of the tool 10 will be apparent. In conventional manner, a wedge such as 40, or a screwdriver 41, may be inserted between the upraised window 42 and the outer sill 44 of the vehicle door. The tool is inserted through the gap now provided in the flexible weatherstrip and moved downwardly until the distal tip of the tool passes below the bottom of the window. With the distal tip of the rod 25 extended, the tool is slid toward the vertical link rod 46 of the latch whose upwardly projecting push-button or post 48 is in the depressed, locking condition. The tool is moved until the hook 26 is engaged around the link rod 46. Withdrawal of the second handle 28 retracts the rod 25 so that the latch link rod 46 is firmly gripped thereby, whereupon the tool 10 is lifted upwardly to raise the post 48 and release the door handle. The tool 10 may now be removed by simply extending the rod 25 and unhooking the hook 26 from the vertical link rod 46.

Figure 6:
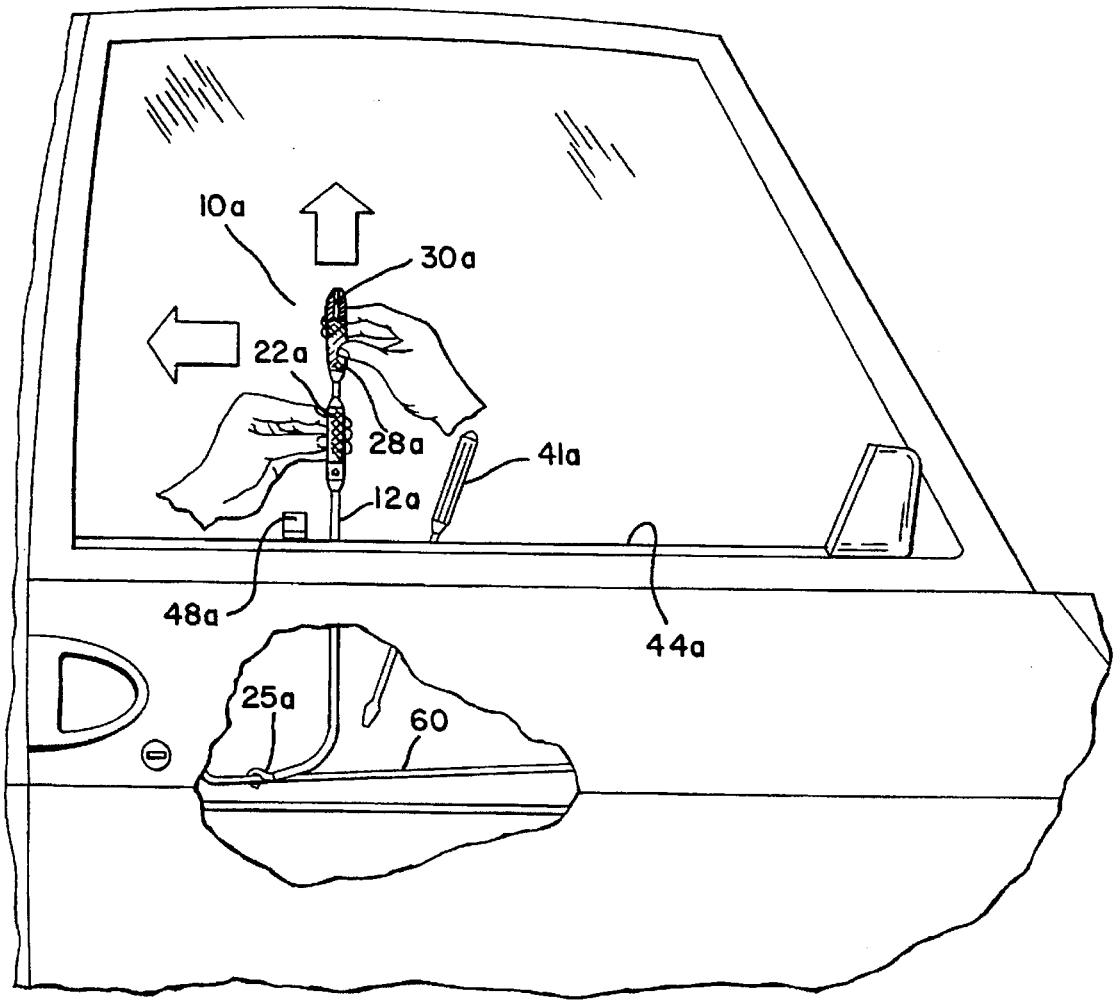
FIG. 6 is a view similar to FIG. 4, but showing another embodiment of the tool in operation on a horizontal linkage.
Figure 7:
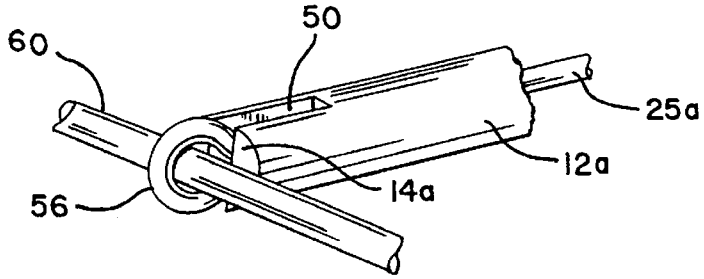
FIG. 7 is an enlarged fragmentary perspective view showing the tool positively gripping a horizontal linkage.

A second embodiment of the invention, 10*a*, is illustrated in FIGS. 6 and 7. Tool 10*a* is of substantially similar construction and comprises a tube 12*a* having a first handle 22*a* mounted thereon and a gripping rod 25*a* slidably positioned therein. An operating handle 28*a* is secured to the proximal projecting end 30*a* of the rod 25*a*. It is important to note, however, that the slot 50 formed in the distal end 14*a* of the tube 12*a* is vertically oriented. Likewise, the hook 56 formed in the distal end of the rod 25*a* is vertically oriented and opens downwardly as indicated. This vertical orientation of the hook 56 and slot 50 enables the tool 10*a* to positively grip a horizontal linkage rod such as 60. Operation of the tool 10*a* is otherwise the same as previously described with regard to the tool 10.

In the embodiments illustrated, the tubes 12, 12*a*, and gripping rods 25, 25*a* are made of relatively rigid metals, such as stainless steel, so that undesirable bending or deflection of the tool during use is virtually prevented. Similarly, by sheathing the rod tips 26 or 56 within the slots 18 or 50 during insertion and withdrawal of the tool, damage or bending of the rod is prevented.

From the foregoing, it should be apparent that the invention provides an efficient and simple to use tool for engaging and releasing the vertical latch post or horizontal linkage of car doors. It should be appreciated that preferred embodiments of the invention have been described herein for illustrative purposes only and are not otherwise limiting of the structural concepts of the invention. Thus, for example, the tool may be effectively employed to grip and move any rod-like latching link, even if the same is not vertically or horizontally oriented as illustrated herein. Accordingly, changes and variations may be made by those skilled in the art without departing from the spirit and scope of the invention as defined in the appended claims.

What is claimed is:

1. A tool for releasing the latch of locked doors of vehicles when the door window is closed, said vehicle having a latching linkage rod within the door cavity, said tool comprising:

an elongate one-piece tube having a distal end and a proximal end, said tube being of uniform dimension over its length and said tube being relatively rigid and having a gradual arcuate bend at the distal end thereof;

a thin one-piece rod reciprocally mounted in said tube having distal and proximal ends projecting outwardly from the distal and proximal ends of the tube, said tube being of uniform dimension over its length, said tube and rod being in close fitting sliding relationship with one another over the length of the tube;

hook means on the outwardly projecting distal end of said thin rod adapted to engage the linkage rod;

a slot in the distal end of said tube adapted to sheathe portions of said hook means in a retracted position; and an operating handle on the outwardly projecting maximal end of the thin rod and adapted to reciprocate said rod relative to said tube so that said hook means is movable between said retracted position, a linkage rod engaging position spaced from the distal end of said tube and a linkage rod gripping position adjacent the distal end of said tube, said tube being insertable into the door cavity alongside the window and movable for engaging said linkage rod with said hook means in said engaging position, and said rod being thereafter reciprocable by said operating handle to move said hook means into said gripping position wherein said hook means cooperates with the distal end of said tube to positively grip said linkage rod for unlatching movement thereof.

2. A tool according to claim 1 wherein said thin rod comprises a relatively rigid metal.

3. A tool according to claim 2 comprising a fixed handle on said tube inwardly of the proximal end thereof, said operating handle being slidably mounted on the tube providing for two-hand operation of the tool.

4. A tool according to claim 1 wherein said slot and hook means lie in a common substantially horizontal plane for gripping of a substantially vertical latching linkage rod.

5. A tool according to claim 1 wherein said slot and hook means lie in a common substantially vertical plane for gripping a substantially horizontal latching linkage rod.

6. A tool for releasing the latch of locked doors of vehicles when the door window is closed, said vehicle having a latching linkage rod within the door cavity, said tool comprising:

an elongate tube adated to be inserted into the door cavity, said tube being of uniform outer diameter over its length and said tube being relatively rigid and having a gradual arcuate bend at the distal end thereof;

a thin one-piece rod reciprocally mounted in said tube, said rod being relatively rigid and of uniform diameter over its length, said tube and rod being in close fitting sliding relationship with one another over the length of the tube;

gripping means on distal ends of said rod and tube adapted to engage and exert a positive grip on the linkage rod for moving the same to release the door latch;

sheath means on said tube for selectively protecting said gripping means; and handle means on the proximal ends of said rod and tube operable to reciprocate said rod relative to said tube so that said gripping means is movable between a linkage rod engaging position spaced from the distal end of said tube and a linkage gripping position adjacent the distal end of said tube, said tube being insertable into the door cavity alongside the window and movable for engaging said linkage rod within said gripping means in said engaging position, and said rod being thereafter reciprocable by said handle means to move said gripping means into said gripping position to positively grip said linkage rod for unlatching movement thereof.

7. A tool according to claim 6 wherein said gripping means comprises an eyelet on the distal end of said thin rod adapted to hook the linkage rod whereupon retraction of the thin rod from said engaging position brings the eyelet and distal tip of the tube into positive gripping engagement with the linkage rod.

8. A tool according to claim 7 wherein said sheath means comprises a slot in the distal end of said tube, said slot adapted to sheathe portions of said eyelet when the thin rod in a fully retracted position.

9. A tool according to claim 8 wherein said slot and eyelet are substantially horizontal and adapted to engage and grip a substantially vertical latching linkage rod.

10. A tool according to claim 8 wherein said slot and eyelet are substantially vertical and adapted to engage and grip a substantially horizontal latching linkage rod.

11. A tool according to claim 6 wherein said handle means comprises a first handle fixedly mounted on said tube inwardly of the proximal end of the tube.

12. A tool according to claim 11 comprising a segment of said thin rod extending from the proximal end of said tube and said handle means comprises a second handle secured to the extending segment of said thin rod for reciprocating movement of said rod within said tube, said second handle being slidable on said tube wherein said handles are cooperable for two-handed operation of the tool.

* * * * *